US006227174B1

(12) United States Patent
Hedrick et al.

(10) Patent No.: US 6,227,174 B1
(45) Date of Patent: May 8, 2001

(54) PLUNGER-ACTIVATED UNIT INJECTOR FOR INTERNAL COMBUSTION ENGINES

(75) Inventors: John C. Hedrick, Boerne; Robert W. Burrahm, San Antonio, both of TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/474,176

(22) Filed: Dec. 29, 1999

(51) Int. Cl.[7] ..... F02M 37/04
(52) U.S. Cl. ..... 123/495; 123/507; 417/380
(58) Field of Search ..... 417/380, 364; 123/497, 495, 507, 508

(56) References Cited

U.S. PATENT DOCUMENTS

| | | | | |
|---|---|---|---|---|
| 1,386,832 | | 8/1921 | Bailly . | |
| 1,499,794 | * | 7/1924 | Wennerby | 123/495 |
| 1,843,606 | | 2/1932 | Leonard . | |
| 2,462,854 | * | 1/1949 | Gates | 417/380 |
| 2,569,233 | * | 9/1951 | Dickson | 417/380 |
| 2,596,360 | * | 5/1952 | Blakeway | 417/380 |
| 2,846,987 | | 8/1958 | Nettel . | |
| 2,917,034 | * | 12/1959 | Bessiere | 123/495 |
| 4,048,971 | | 9/1977 | Pritchett | 123/139 R |
| 4,141,675 | * | 2/1979 | O'Neill | 123/495 |
| 4,306,680 | * | 12/1981 | Smith | 239/87 |
| 4,599,983 | * | 7/1986 | Omachi | 123/497 |
| 5,067,467 | * | 11/1991 | Hill et al. | 123/497 |
| 5,685,272 | * | 11/1997 | Paul et al. | 123/446 |
| 5,775,305 | * | 7/1998 | Bolger | 123/497 |
| 5,785,505 | * | 7/1998 | Price | 417/364 |

* cited by examiner

*Primary Examiner*—Carl S. Miller
(74) *Attorney, Agent, or Firm*—Baker Botts L.L.P.

(57) ABSTRACT

An electronically controlled unit injector for internal combustion engine. The unit injector is mounted on a cylinder and has a plunger that extends into the combustion chamber. Fuel flow through the unit injector is accomplished by the plunger, which moves upward into the unit injector in response to upward motion of the piston. This motion displaces fuel and pressurizes a fuel path within the unit injector, including a pressure void at the tip of the needle. The pressurized fuel lifts the needle, which permits fuel to exit through injection spray holes into the combustion chamber.

18 Claims, 2 Drawing Sheets

PLUNGER-ACTIVATED UNIT INJECTOR FOR INTERNAL COMBUSTION ENGINES

TECHNICAL FIELD OF THE INVENTION

This invention relates to internal combustion engines, and more particularly to fuel injection systems.

BACKGROUND OF THE INVENTION

Many of today's lightweight and/or high-speed engines, which are typically two-cycle engines, do not have a cam and valve overhead. When such engines are designed for fuel injection, means other than the cam must be used to actuate the injector. Addition of actuator components presents design problems, in that such components must not unduly increase the weight and cost of the engine. The actuation components must also be capable of withstanding the forces that will be exerted within the injection system due to high injection pressures and fast operation. If the actuation components require lubrication, this further increases the weight, cost, and complexity of the engine.

One alternative to a conventional cam-driven injection system is to use an injection pump mechanism external to the injector assembly. An example is a pump line nozzle injection system. However, there are limitations on where the injection pump can be mounted relative to the injector. This limitation is due to the compressibility to the fuel and the transport delay of the fuel pulse from the injection pump to the injector. This is an issue because of the high operating speed of these small engines.

Another alternative is a "unit injector", so called because their pumping mechanism is integral to the injector assembly. An example is a cam-actuated unit injector, such as that used in on-highway diesel engines.

However, for small two cycle engines, this type of cam actuation would present the weight and lubrication problems discussed above.

SUMMARY OF THE INVENTION

One aspect of the invention is a unit injector for an internal combustion engine. A main body has a size and shape appropriate for insertion in an opening in the cylinder head. The main body further has a fuel supply port and a fuel return port and a fuel path between the fuel supply port and the fuel return port. A control valve is operable to open or close the fuel path forward of the fuel return port. A plunger extends from the main body downward into the combustion chamber. The plunger is moveable up and down within the main body in response to movement of the piston.

In one embodiment of the invention, the needle/spray assembly is inside the plunger. At least one spray aperture is at the bottom tip of the plunger. The injector needle is located above the spray apertures, and is moveable up and down within the plunger.

The fuel path before the control valve has a first void above the plunger and a second void at the tip of the needle, which become pressurized when the control valve is closed. The plunger is forced upward by the piston, which displaces fuel above the plunger and causes the injection pressure. This pressurization causes the needle to lift, opening the spray apertures.

The above-described invention solves various problems previously associated with fuel injection for lightweight high-speed engines. It permits such engines to be used with injection fuels, such as diesel, jet (i.e. JP-8, JP-6), or other heavy fuels. An example of engines with which the invention is especially useful is engines for lightweight unmanned aircraft, which are typically high-speed two-cycle engines.

An advantage of the invention is that the engine piston provides the pressure for fuel injection, via the plunger action. No pumping component other than the injector plunger and a small low-pressure primary fuel pump need be added to the injection assembly. This satisfies design criteria for injection systems that must be lightweight and compact.

The unit injector is suitable for high engine speeds. The pumping actuation provided by the plunger provides pumping mechanics in close proximity to the injection needle.

DETAILED DESCRIPTION OF THE INVENTION

The following description is in terms of a unit injector for a liquid fuel injection engine. Such engines use fuels such as diesel, alcohols, and JP-8. However, the unit injector could also be used with duel fuel engines as a pilot injector to ignite a second fuel, such as in the case of duel fuel natural gas, propane, or butane engines.

Furthermore, the following description is in terms of a two-cycle engine. As explained below, the unit injector operates such that injection occurs on each up piston stroke. Two-cycle engines lack a cam that may be used to actuate the injector, thus motivating the development of alternate pumping mechanisms for the injector, in particular, the unit injector of the present invention. However, the unit injector could be used with a four-cycle engine, if desired, as an alternative to the available cam actuation. In the case of a four-cycle engine, electronic controls could be used to operate the unit injector on every other up piston stroke.

Figure 1:
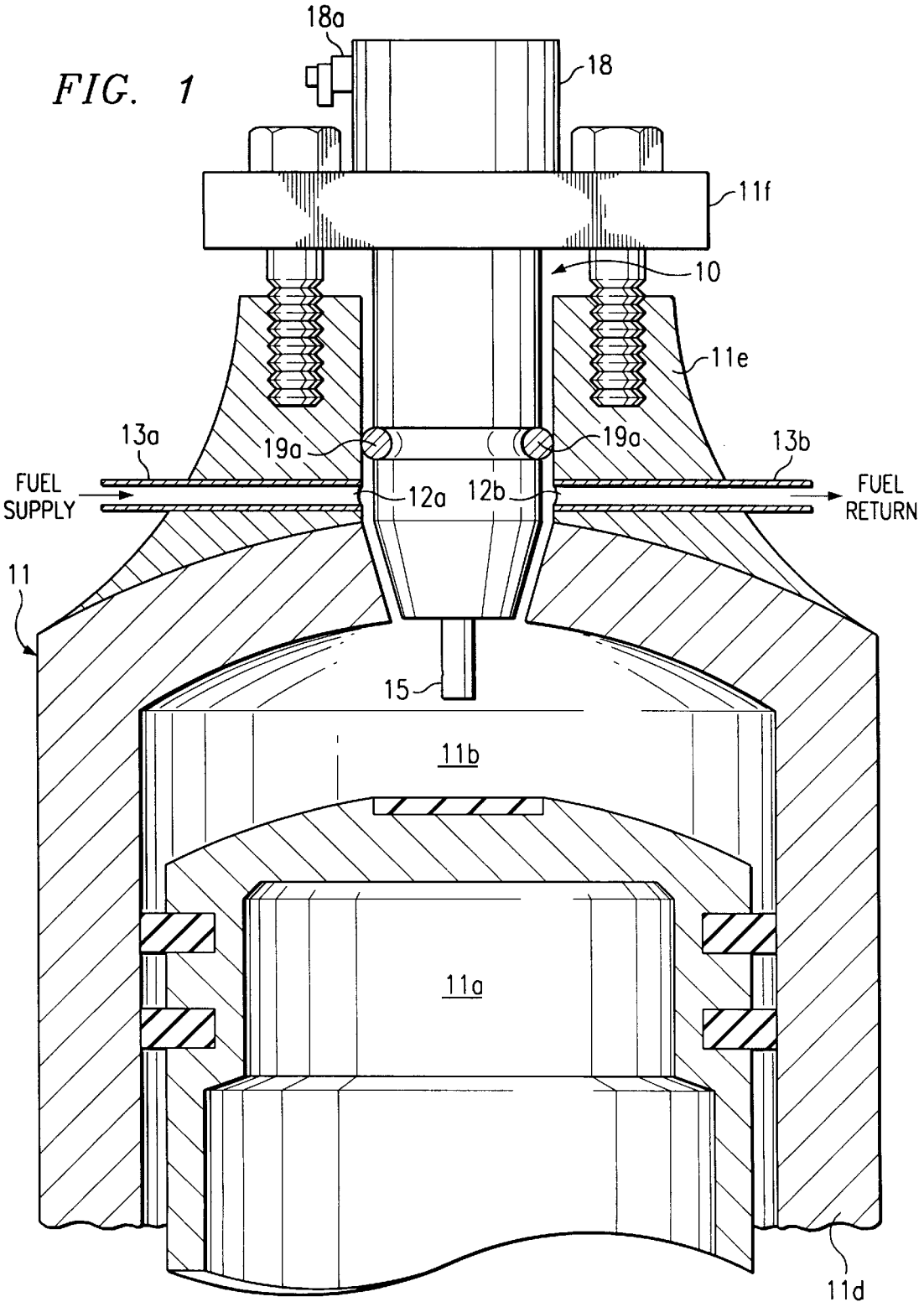
FIG. 1 is a cross sectional view of an engine cylinder, and of a unit injector in accordance with the invention.

FIG. 1 is a cross sectional view of a unit injector 10 in accordance with the invention, mounted atop an engine cylinder 11 for direct injection of fuel. Cylinder 11 may be a conventional two-cycle engine cylinder, having a piston 11*a* and a combustion chamber 11*b* above the piston 11*a*. In the example of FIG. 1, the engine is a lightweight engine having a cylinder "jug" lid that integrates the cylinder liner and cylinder head.

Various means may be used to attach unit injector 10 to the cylinder 11. In the example of FIG. 1, cylinder 11 has an annular collar lie at its upper surface. A contact pad on collar lie receives injector 10, which extends downwardly through the cylinder head. Unit injector 10 may be designed with appropriate surfaces for o-rings 19*a* fitted between the outer surface of injector 10 and the inner surface of collar 11*a*. A hold down clamp 11*f* secures injector 10 to the combustion chamber 11.

Unit injector 10 has a supply port 12*a* and a return port 12*b*, which receive and discharge fuel, respectively. A fuel supply line 13*a* provides fuel to a supply port 12*a*, and a fuel return line 13*b* transports fuel away from injector 10 via fuel return port 12*b*. Fuel lines 13*a* and 13*b* are both connected to a fuel tank (not shown). Like other unit injectors, fuel in excess of that required for each injection event is maintained within the injector 10 for lubrication and cooling. Thus, the injector 10 is "overfueled", with excess returning to tank.

The fuel to the injector 10 is supplied via an external primary pump (not shown). It is assumed that the fuel is appropriately filtered, and is provided at a relatively low pressure (relative to the injection pressure). Pressures to be expected are in the range of 40 to 150 psi, depending on the fuel and the engine operating speed and other design parameters. This pressure to the injector 10 is a supply pressure, and ensures that the injector is filled before each injection event.

A plunger 15 is moveable up and down within the body of injector 10. As explained below, unit injector 10 is actuated by the piston 11*a*, whose action forces plunger 15 upward into the injector body. Plunger 15 thereby displaces fuel in the body of unit injector 10, which creates a flow of fuel through the injector 10. Depending on valve activity, unit injector is sufficiently pressurized to hydraulically lift injection needles. This eliminates the need for cams and valve trains to drive the injector.

A solenoid 18 is attached to the top surface of injector 10. Appropriate electrical connections are made via an interface 18*a*. This connection is to a engine control unit (ECU) that controls the injection timing and quantity as with any traditional electronically controlled fuel injector.

Figure 2:
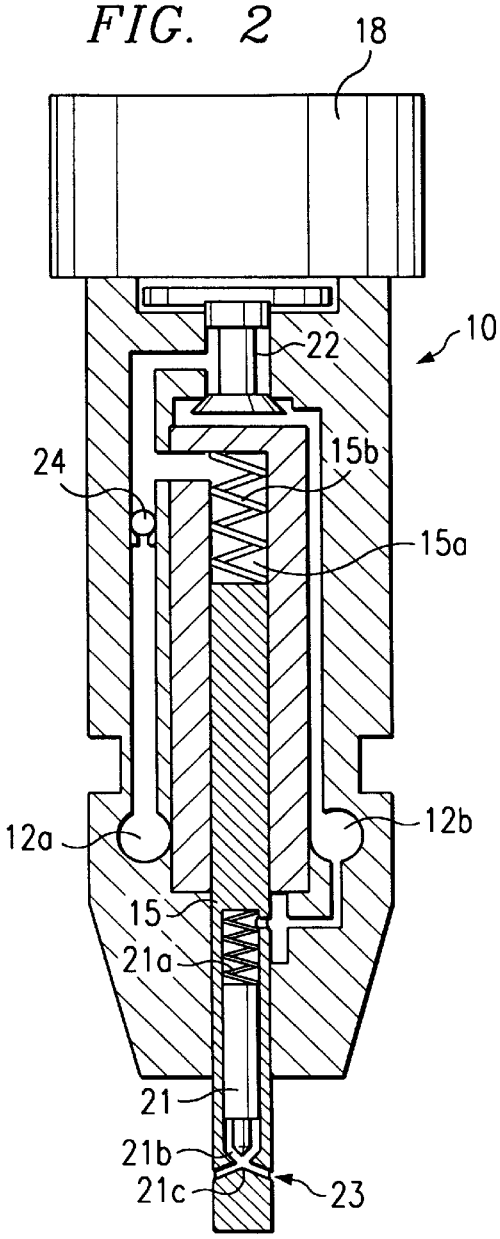
FIG. 2 is a cross sectional view of one embodiment of the unit injector of FIG. 1.

FIG. 2 is a cross sectional view of unit injector 10 in further detail, not installed on the cylinder 11. A plunger 15 located in the core of injector 10, inside a plunger channel 15*a*. Plunger 15 and plunger channel 15*a* are both cylindrical in shape, and plunger 15 has an inner channel that contains an injection needle 21. Plunger spring 15*b* is located in channel 15*a*, above plunger 15. The space above plunger 15 is open to the fuel path within unit injector 10.

A control valve 22 is located in the fuel path within unit injector 10 between the supply port 12*a* and the return port 12*b*. Control valve 22 is operated by solenoid 18, and is pressure balanced, so that it will operate under pressure conditions within injector 10. In the example of FIG. 2, control valve 22 is located at the top of injector 10, but other locations are possible. In general, a close coupling between of valve 22 and the injection site tends to enhance performance.

Plunger spring 15*a* responds to the action of piston 11*a*. Piston 11*a* pushes against the bottom of plunger 15 during the up stroke of piston 11*a*. The combined effect of piston 11*a* pushing on plunger 15 and the closing of control valve 22 results in pressurization within injector 10. During this period of the upstroke, fuel injection occurs. Thus, the length of plunger 15 extending within combustion chamber 11*a* need only be enough to provide a sufficient duration time for injection.

In the embodiment of FIG. 2, the injector needle 21 is mounted inside plunger 15, in a needle channel. Needle spring 21*a* is located in that channel above needle 21. As explained below, spring 21*a* responds to fuel pressure under the tip of needle 21 (at location 21*b*), when the pressure there exceeds the spring force. In the example of FIG. 2, a channel is provided within plunger 15 to supply fuel to a needle pressure chamber 21*b* under and around the tip of needle 21. The channel above needle 21 is exposed to return pressure through a passage that connects either to return port 13*b* or between supply port 13*a* and check valve 24. This prevents injector 10 from becoming hydraulically locked during the injection event.

Needle 21 rests on a needle seat 21*c*, when not pushed upwardly from needle seat 21*c* by fuel pressure. At the center of needle seat 21*c* is an opening to spray holes 23. Spray holes 23 are arranged in a circular pattern around the bottom tip of plunger 15. The needle seat 21*c* acts as a valve, controlling whether fuel exits from the opening into combustion chamber 11*b* via spray holes 23.

As indicated above, unit injector 10 has various internal fuel channels, which provide a fuel path from supply port 12*a* through the interior of injector 10. Fuel enters at supply port 13*a*, and travels past a check valve 24. The use of check valve 24 assures the flow direction of the fuel through the control valve 22 when the plunger 15 is in motion. This flow helps with cooling and lubrication of the injector 10, and with purging of the injector 10.

Fuel fills the void in plunger channel 15*a* above plunger 15, and the void at the tip of needle 21. These voids are part of the fuel path "forward" of control valve 22. Fuel continues past control valve 22, depending on whether valve 22 is open or closed. If valve 22 is open, fuel may exit out return port 13*a*. If valve 22 is closed, the pressure in the fuel path forward of valve 22 increases.

Thus, in general, the fuel path is such that fuel fills appropriate pressure chambers forward of valve 22. These pressure chambers include the void in plunger channel 15*a* above plunger 15 and the void around the tip of injection needle 21. The configuration of the fuel channels within injector 10 may vary, provided that these voids may be pressurized by displacement of plunger 15 when valve 22 is closed.

In operation, plunger 15 acts as a "pump" to provide fuel flow through injector 10. Specifically, the upward motion of plunger 15 in response to piston 11*a* causes a displacement of the fuel within injector 10, which in turn causes a flow of the fuel through injector 10. The fuel flow is prevented from flowing back through supply port 13*a* by check valve 24.

As the plunger 15 displaces the fuel, the fuel reaches control valve 22. If valve 22 is open, fuel is allowed to exit the injector 10 via a fuel return port 13*b*.

If valve 22 is closed, fuel is prevented from exiting the injector 10. The pressure increases in the injector 10 and is transmitted to the bottom of the injector needle 21. The fuel pressure increases until the pressure overcomes the spring force on the top of the injector needle 21. At this time, the hydraulic force below the needle 21 exceeds the spring force.

Fuel injection may occur on the upward stroke of piston 11*a* after it contacts plunger 15 and before it reaches top dead center (TDC) of the piston stroke. After TDC, piston 11*a* is moving downward, ending the pumping pressure. However, this is acceptable for high-speed engines due to the need for early injection timing caused by combustion delay of the fuel when injected into the combustion chamber.

Thus, at some point on the upward piston stroke, after piston contacts plunger 15 and before TDC, fuel injection may occur. During this time valve 22 is closed, causing fluid pressure to increase in the fuel-filled annulus below needle 21. This pressure causes needle 21 to be lifted off the needle seat 21*c*, causing fuel to be injected into the combustion chamber 11*c* through the injector spray holes 23. After a desired period of time, solenoid 18 is de-energized and control valve 22 opens. This causes a sudden drop in the fuel pressure within injector 10, by allowing the fuel to exit the injector 10 via the return port 13*b*. As the pressure under the needle 21 drops below the force provided by needle spring 21*a*, the injector needle 21 drops down onto needle seat 21*c*, closing the flow path to the spray holes 23.

The use of a single needle 21 in the center of the plunger 15 causes the spray pattern to be located in the center of the combustion chamber 11*a*. This configuration also provides a fuel flow through the plunger 15, and thus some cooling of the plunger 15. Additionally, this configuration offers an opportunity to maintain a constant target for the injection plumes, relative to the top of the piston 12. This is especially advantageous if a re-entrant combustion chamber (not shown) is used.

Figure 3:
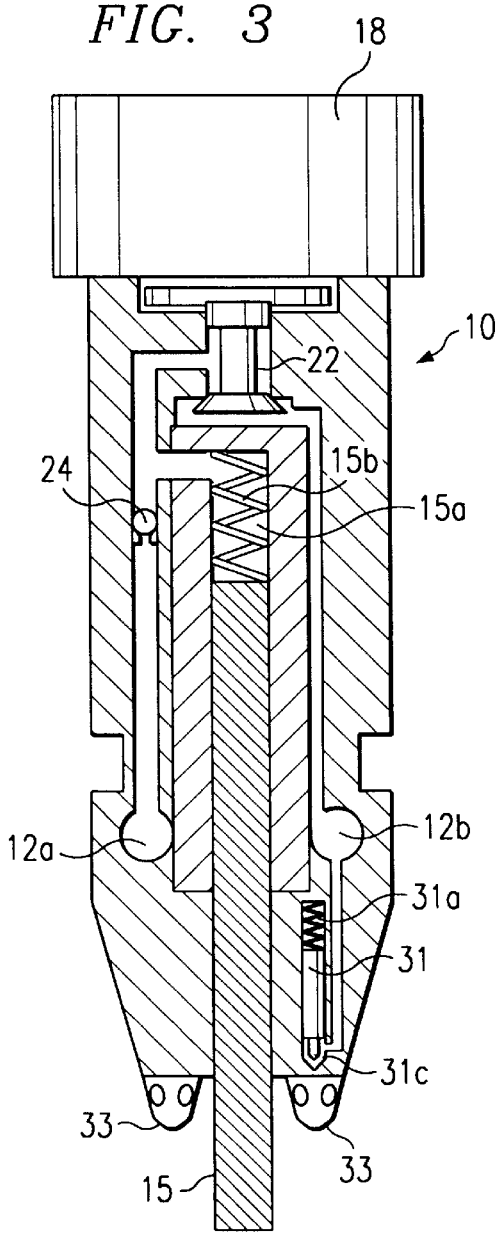
FIG. 3 is a cross sectional view of a second embodiment of the unit injector of FIG. 1.

FIG. 3 illustrates a second embodiment of injector 10, with a different configuration of injector needles and spray holes. In this embodiment, there are multiple needles 31 at the bottom of unit injector 10. However, needles 31 are located around, rather than inside, plunger 15. Although only needle 31 is explicitly shown, additional needles 31 would have the same associated structure.

Each needle 31 has one or more associated fuel injection spray holes 33. Needles 31 and spray holes are arranged in locations in the bottom of injector 10, beside plunger 15. At each such location, there is at least one spray hole 33, an injector needle 31, and a needle spring 31*a* above the needle 31.

Like needle 21 of FIG. 2, needles 31 each rest on a needle seat 31*c*. The fuel path within injector 10 includes a channel that provides fuel to a void at the tip of each needle 31, which permits the above-described hydraulic pressure to lift the needle above its needle seat 31*c*.

The embodiment of FIG. 3 suggests a pair of needles 31, on opposing sides of plunger 15. However, injector 10 can be structured in various ways so as to provide whatever arrangement and number of needles 31 and spray holes 33 meet the needs of the engine.

Regardless of the needle configuration, the basic operation of injector 10 is the same. As described above, the combined operation of plunger 15 and valve 22 provide pressure within injector 10, which pushes the injection needle(s) off a needle seat, opening a path to spray holes.

The dynamics associated with plunger 15 can affect operation of injector 10. After piston 11*a* contacts plunger 15, there is an optimum time period, prior to the time when the piston 15 slows down, in which the maximum pressure within injector 10 can be achieved. Also, the diameter of plunger 15 can affect pressure dynamics. These dynamics can be used to provide a desired high initial injection pressure and a dropping injection pressure toward the end of the injection event. This injection pressure shape can be designed to reduce the ignition delay that is commonly a problem with high speed, direct injection, compression ignition engines.

OTHER EMBODIMENTS

Although the present invention has been described in detail, it should be understood that various changes, substitutions, and alterations can be made hereto without departing from the spirit and scope of the invention as defined by the appended claims.

What is claimed is:

1. A unit fuel injector to be mounted in a cylinder head above the combustion chamber of a piston-actuated internal combustion engine, comprising:

a main body having a size and shape appropriate for insertion in an opening of the cylinder head, having a fuel supply port and a fuel return port, and having a fuel path between the fuel supply port and the fuel return port;

a plunger extending downwardly into the combustion chamber, and moveable up and down within the main body in response to striking contact with an engine piston, the plunger having at least one spray aperture at its bottom tip;

an injector needle located in the plunger above the spray apertures, moveable up and down within the plunger, and operable to open the spray aperture when moved; and a control valve operable to close the fuel path forward of the fuel return port;

wherein the fuel path before the control valve has a first void above the plunger and a second void at the tip of the needle.

2. The fuel injector of claim 1, wherein the plunger is in the central core of the main body.

3. The fuel injector of claim 1, wherein the control valve is solenoid-activated.

4. The fuel injector of claim 1, wherein the control valve is located at the top of the unit injector.

5. The fuel injector of claim 1, further comprising a plunger spring above the plunger, operable to counteract the upward force provided by the piston.

6. The fuel injector of claim 1, further comprising a needle spring above the needle, operable to counteract the upward force provided by pressure in the void at the needle tip.

7. A unit fuel injector to be mounted in a cylinder head above the combustion chamber of an internal combustion engine, comprising:

a main body having a size and shape appropriate for insertion in an opening of the cylinder head, having a fuel supply port and a fuel return port, and having at least one spray aperture set;

a plunger moveable up and down within the main body in response to striking contact with an engine piston, the plunger extending downwardly into the combustion chamber;

a plunger spring above the plunger;

an injector needle located above each spray aperture set, moveable up and down within main body, and operable to open the spray aperture set when moved;

a needle spring above the needle; and a control valve operable to close the fuel path forward of the fuel return port;

wherein the fuel path before the control valve has voids above the plunger and the tip of the needle.

8. The fuel injector of claim 7, wherein the spray aperture set is located on the bottom surface of the main body.

9. The fuel injector of claim 7, wherein the plunger is in the central core of the main body.

10. The fuel injector of claim 7, wherein the control valve is solenoid-activated.

11. The fuel injector of claim 7, wherein the control valve is located at the top of the unit injector.

12. The fuel injector of claim 7, further comprising a plunger spring above the plunger, operable to counteract the upward force provided by the piston.

13. The fuel injector of claim 7, further comprising a needle spring above the needle, operable to counteract the upward force provided by pressure in the void at the needle tip.

14. A method of injecting fuel into the combustion chamber of a piston-actuated internal combustion engine, comprising the steps of:

inserting a plunger into the top of the combustion chamber, the plunger upwardly moveable in response to the piston directly striking and pushing on the plunger;

inserting at least one injection needle assembly above the combustion chamber, each needle assembly having an injection needle operable to open and close spray apertures that open into the combustion chamber;

providing a fuel path that connects a void on top of the plunger to a void at the tip of the needle;

filling the fuel path with fuel to be injected into the combustion chamber;

pressurizing the void on top of the plunger in response to upward motion of the plunger; and transmitting, via the fuel path, pressure from the void on top of the plunger to the void at the tip of the needle, such that the needle moves upwardly and opens the spray aperture.

15. The method of claim 14, wherein the pressurizing step is accomplished by closing a valve in the fuel path.

16. The method of claim 15, wherein the closing of the valve occurs after the piston contacts the plunger and before the piston reaches its top position.

17. The method of claim 14, wherein the plunger and needle assembly are housed in a unit injector body having a fuel input port that delivers fuel to an input side of the fuel path and a fuel output port that permits fuel to exit the main body.

18. The method of claim 14, wherein the transmitting step is performed such that a fuel flow is maintained in the fuel path.

* * * * *